US008087103B2

(12) United States Patent
Leibfried

(10) Patent No.: US 8,087,103 B2
(45) Date of Patent: Jan. 3, 2012

(54) TOILET AND TOILET SEAT MOUNTING APPARATUS

(76) Inventor: Michael R. Leibfried, Lancaster, WI (US)

( * ) Notice: Subject to any disclaimer, the term of this patent is extended or adjusted under 35 U.S.C. 154(b) by 1382 days.

(21) Appl. No.: 11/581,900

(22) Filed: Oct. 17, 2006

(65) Prior Publication Data

US 2007/0089222 A1 Apr. 26, 2007

Related U.S. Application Data

(60) Provisional application No. 60/729,084, filed on Oct. 21, 2005.

(51) Int. Cl.
*A47K 13/00* (2006.01)

(52) U.S. Cl. ..... 4/234; 4/236; 4/240

(58) Field of Classification Search ..... 4/234, 236, 4/240, 238

See application file for complete search history.

(56) References Cited

U.S. PATENT DOCUMENTS

| | | | | |
|---|---|---|---|---|
| 651,354 | A | 6/1900 | Hogan | |
| 2,004,023 | A | 6/1935 | Uffen | |
| 2,434,249 | A * | 1/1948 | Olson | 4/234 |
| 2,593,534 | A | 4/1952 | Campanelli | |
| 2,849,728 | A | 9/1958 | Gyllenberg | |
| 3,055,015 | A | 9/1962 | Silverman | |
| 3,063,063 | A | 11/1962 | Brooks | |
| 3,262,481 | A | 7/1966 | Hanfland | |
| 3,550,164 | A | 12/1970 | Pease | |
| 3,613,130 | A | 10/1971 | Sansone | |
| 3,623,767 | A | 11/1971 | Condon | |
| 4,087,884 | A * | 5/1978 | Seiderman | 16/252 |
| 4,173,802 | A | 11/1979 | Wikstrom | |
| 4,291,422 | A | 9/1981 | Shoemaker | |
| 4,326,307 | A | 4/1982 | Baillie et al. | |
| 4,367,567 | A | 1/1983 | Sendoykas | |

(Continued)

FOREIGN PATENT DOCUMENTS

CA 2305976 10/2001

(Continued)

OTHER PUBLICATIONS

International Search Report for PCT/US2007/80176, mailed Apr. 15, 2008.

(Continued)

*Primary Examiner* — Gregory Huson
*Assistant Examiner* — Karen L Younkins
(74) *Attorney, Agent, or Firm* — Foley & Lardner LLP

(57) ABSTRACT

A toilet including a toilet bowl having a bowl flange with apertures and a toilet seat. The seat has a seat ring configured to rest on the bowl flange and a seat mounting means, the mounting means having at least one ring portion extending from the ring, two flange portions, each flange portion being aligned with one of said flange apertures, and an connecting means joining said ring portion and said flange portions, said connecting means permitting rotation of said ring portion between a generally horizontal use position and an over center storage position position. The mounting apparatus for the seat includes a post receptacle secured in each of the flange apertures, an elongate post secured to and extending downwardly from each of the seat flange portions and longitudinally extendable through and beyond the aligned receptacle to permit the seat to be elevated above the bowl flange to facilitate maintenance. Means are provided between the receptacles and the posts to guide the seat and to releasably support the post in the elevated position for cleaning and maintenance.

27 Claims, 3 Drawing Sheets

U.S. PATENT DOCUMENTS

| | | | | |
|---|---|---|---|---|
| 4,639,147 | A | 1/1987 | Schwarz | |
| 4,884,841 | A | 12/1989 | Holley | |
| 4,970,731 | A | 11/1990 | Fait | |
| 4,974,262 | A | 12/1990 | Rosen | |
| 5,063,617 | A | 11/1991 | Ward et al. | |
| 5,091,999 | A | 3/1992 | Turner, Jr. | |
| 5,212,840 | A | 5/1993 | Caldwell | |
| 5,638,554 | A | 6/1997 | Corzine | |
| 5,720,753 | A | 2/1998 | Sander et al. | |
| 5,775,863 | A | 7/1998 | Anderson | |
| 5,946,740 | A | 9/1999 | Sorimachi | |
| 6,012,886 | A | 1/2000 | Tanamura et al. | |
| 6,070,295 | A | 6/2000 | Hulsebus | |
| 6,101,640 | A | 8/2000 | Brewer et al. | |
| 6,112,335 | A | 9/2000 | Gaston | |
| 6,338,167 | B1 | 1/2002 | Baker et al. | |
| 6,381,762 | B1 | 5/2002 | Moser | |
| 6,643,851 | B1 | 11/2003 | Janes | |
| 6,754,917 | B1 | 6/2004 | Rhoades | |
| 6,763,529 | B1 | 7/2004 | Richter | |
| 6,807,686 | B1 | 10/2004 | Janes | |
| 7,137,154 | B2 * | 11/2006 | Miller et al. | 4/234 |
| 2003/0182719 | A1 | 10/2003 | Glesson | |
| 2004/0223829 | A1 | 11/2004 | Barnett et al. | |
| 2006/0260029 | A1 | 11/2006 | Kelly | |
| 2007/0294813 | A1 | 12/2007 | Leibfried | |

FOREIGN PATENT DOCUMENTS

| | | | |
|---|---|---|---|
| CA | 2368806 | | 7/2003 |
| CH | 689138 | A5 | 10/1998 |
| DE | 4339200 | A1 | 5/1999 |
| DE | 10038601 | A1 | 2/2002 |
| FR | 2770388 | A3 | 5/1999 |
| JP | 4-101697 | | 9/1992 |
| JP | 2000-005100 | | 1/2000 |

OTHER PUBLICATIONS

First Office Action in Chinese Appln. No. 200680047154.X dated Jan. 8, 2010. (English Translation attached.).

International Preliminary Report on Patentability received for PCT/US2007/080176 dated Mar. 18, 2010.

Written Opinion for PCT/US2007/80176, mailed Apr. 15, 2008.

Supplementary Partial European Search Report for European Appln. No. EP06826141.1 completed Jun. 17, 2010.

United States Patent and Trademark Office, International Search Report in counterpart International Patent Application No. PCT/US2006/040618 (Apr. 23, 2007).

United States Patent and Trademark Office, Written Opinion of the International Searching Authority in counterpart International Patent Application No. PCT/US2006/040618 (Apr. 23, 2007).

Non-Final Office Action; In re: U.S. Appl. No. 12/026,206; Dated: May 9, 2011; Applicant: Michael R. Leibfried, (12 pgs.).

Japanese Office Action (with English Translation) for Application No. 2008-536747, dated Aug. 15, 2011, 16 pages. (English translation of relevant portions of referenced Japanese patent document included).

U.S. Notice of Allowance; in re: U.S. Appl. No. 11/899,891, dated Oct. 21, 2011, Applicant: Michael R. Leibfried, (14 pgs.).

* cited by examiner

TOILET AND TOILET SEAT MOUNTING APPARATUS

CROSS-REFERENCE TO RELATED APPLICATIONS

This patent application claims the benefit of U.S. Provisional Patent Application No. 60/729,084, filed Oct. 21, 2005.

BACKGROUND OF THE INVENTION

Improving the maintenance, the cleanliness and the sanitation features of conventional toilets has been the subject of many efforts to provide improved toilet seats, toilet bowls and means for connecting them. It has been found that cleaning and sanitizing is complicated by the intricacies of hinge-like interconnections between the pivoted seat ring and the flange of a toilet bowl and by the inconvenient location and the often unsavory condition thereof. In many installations the problems are aggravated by the hinge-like interconnection of a separate seat cover mounted above the seat for independent rotation relative thereto. Access to the area around those interconnections is difficult and inconvenient and maintenance in that area is often distasteful. Partial solutions to these problems have been suggested by many.

One early effort to gain accessibility to the seat, bowl flange and the mounting area to facilitate maintenance is shown in U.S. Pat. No. 3,055,015. Bushings are bolted in the bowl flange apertures and a post extends from the seat through the bushing to connect the seat to the bowl flange. Spring arms on the posts engage the bushings to releasably hold the seat in place on the flange. The seat is to be pulled upwardly and totally removed for maintenance. This approach presents additional problems for maintenance personnel. Typically the unsanitary separated seat assembly must be placed on a remote surface for cleaning and sanitizing. This results in excessive handling and subjects additional surface areas to contamination. The open apertures in the flange bushing will collect debris and cleaning materials that are difficult to remove. Moreover, a configuration relying on total separation of the seat assembly from the toilet bowl will encourage vandalism and theft, especially in commercial applications.

Many years later another approach to the same problems was shown in U.S. Pat. No. 4,326,307. In that approach a bolt is secured in each flange aperture with a mounting ball on the bolt above the flange of a residential toilet. This does seal the apertures in the flange against contamination. The seat is supported on each flange ball by a mating hinged fastener. The fastener has a tab and side walls enclosing a slotted socket that engages the associated ball. For maintenance the seat must be pulled from the flange by lifting the tabs and separating the sockets from the balls. Such arrangements also present the problems of excessive handling of the unsanitary detached seat, or seat and cover assembly, and placing it on some remote surface for cleaning and sanitizing. Such an approach using releasable fasteners creates additional new problems. The protruding flange ball creates new problems in bowl flange maintenance and the complex exposed fastener with a tab and socket present additional difficulties in removing and maintaining the seat. Other arrangements for detachment and remote storage are found in the prior art for residential type toilet seats having two hinges, releasably connected to a device secured to the bowl flange. With these prior approaches additional difficulties would be encountered in mounting commercial and traditional toilet seat arrangements.

BRIEF SUMMARY OF THE INVENTION

This invention relates to toilets and toilet seats and more particularly to toilet seat mounting means that overcome the shortcomings in the prior art as discussed above. More specifically, in accordance with this invention a mounting means is provided that maintains a toilet seat, or seat and cover, in three distinct positions. The apparatus maintains the seat and cover in the closed position properly aligned and supported on the bowl flange. The apparatus also permits rotation of the cover, or the seat and cover, to an over center storage position. In addition to the conventional use position and the conventional raised, over center storage position, the apparatus of the invention is unique in that it permits controlled upward movement of the seat or the seat and cover to an elevated position above the bowl flange for maintenance. The apparatus of the invention maintains the seat or the seat and cover in the elevated position to facilitate cleaning the toilet bowl and bowl flange, the toilet seat and cover, the seat mounting means and the surrounding environment. This invention provides temporary storage of the seat, or seat and cover, above the bowl flange with adequate clearance and access to better facilitate cleaning and maintenance. This ease of access is accomplished with a system comprising elongate posts each having a post cap secured to or integral with the seat mounting means. Each post extends downwardly from the mounting means and each is slidably mounted in a respective post receptacle secured within a bowl flange aperture. Each post cap may be integrally formed with the respective seat mounting means or the post cap may be secured to the seat mounting means by conventional means. Each post receptacle is secured in the respective bowl flange aperture by conventional means to provide adequate support for the entire assembly and to close the bowl flange aperture against contamination. The post has a sliding fit in the receptacle and a catch or other interference means releasably supports the post in the elevated maintenance position. The seat, or seat and cover, are easily raised to the elevated cleaning and maintenance position and lowered to rest on the bowl flange when desired. The mounting means can be jointed, like a hinge defining two knuckles and a pin or can be fabricated of flexible material performing in a hinge-like manner.

BRIEF DESCRIPTION OF THE SEVERAL VIEWS OF THE DRAWING(S)

DETAILED DESCRIPTION OF THE INVENTION

Figure 1:
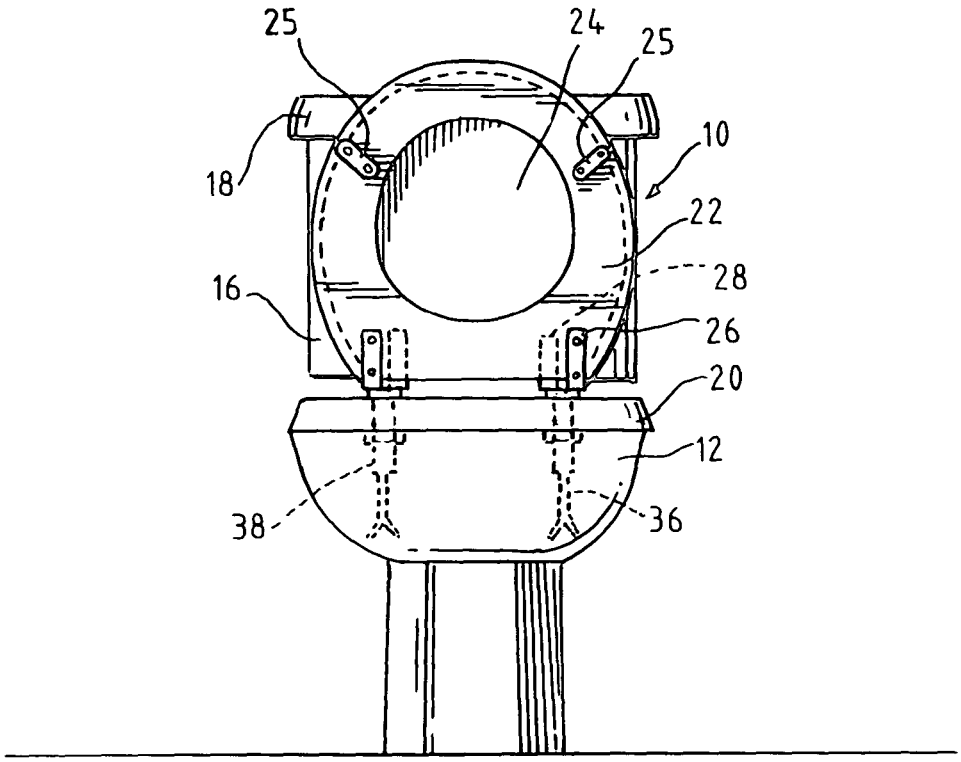
FIG. 1 is a front elevation of a conventional style toilet with parts of the mounting system of the invention shown in broken lines on the toilet bowl flange and a seat and cover in the standard over center storage position.
Figure 2:
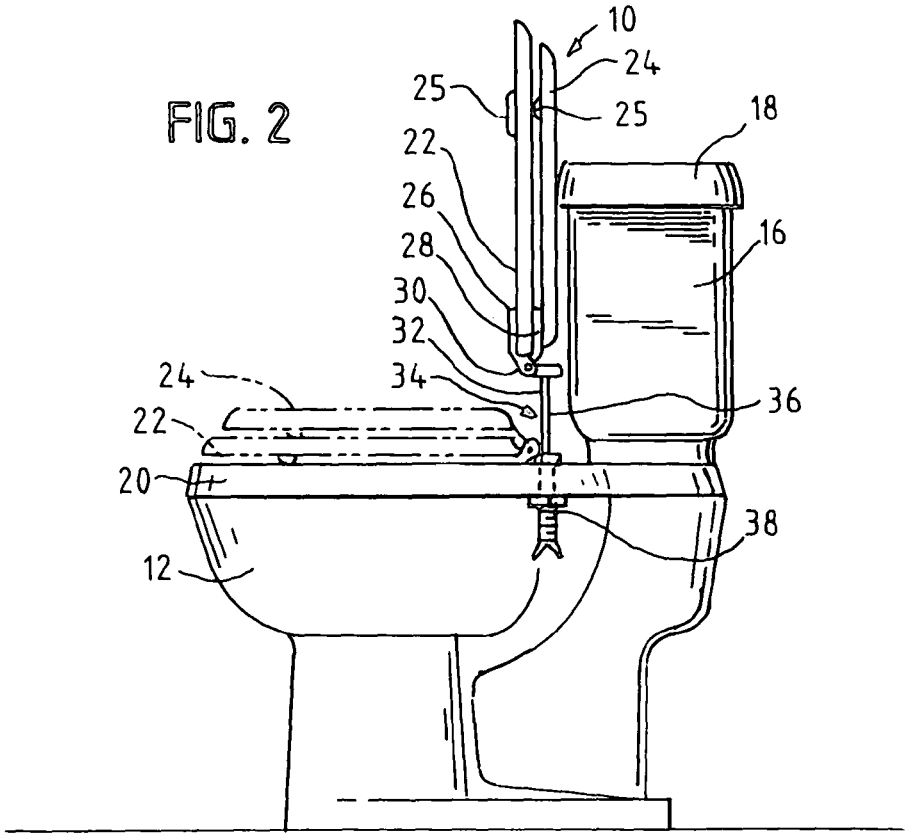
FIG. 2 is a side elevation of the embodiment of FIG. 1 showing the seat and cover in the elevated position for cleaning and maintenance with the seat and cover also shown in the closed position, but in broken lines.

The invention disclosed herein is set forth in the following description, is illustrated in the attached drawings and is the subject of the attached claims. The several embodiments shown and described are examples that further illustrate the invention but should not be construed as in any way limiting its scope. For example, three specific configurations are illustrated in the drawings but the mounting means for the seat ring and the cover can vary widely. Referring to the drawings and particularly to FIGS. 1 and 2, a typical toilet 10 is shown having a bowl 12 with a water tank 16 and a tank cover 18. The bowl 12 has a bowl flange 20 which supports a seat 22 and a seat cover 24 on bumpers 25 shown in an upright or standard over center storage position in FIG. 1. As best seen in FIG. 2, a unique mounting apparatus 34 supports and facilitates the positioning of the seat 22 and seat cover 24. As shown in solid lines, hinges support the seat 22 and the cover 24 in an elevated cleaning and maintenance position on elongate posts 36, as shown in solid lines and in accordance with this invention, and in a closed position on the bowl flange 20, as shown in broken lines. The mounting apparatus of this invention implements the movement of the seat and cover to the three distinct positions shown in FIGS. 1-2. Seat hinge straps 26 and cover hinge straps 28 are mounted for rotation about a hinge pin 30 and are elevated on elongate posts 36 relative to receptacles 38 in bowl flange 20 for cleaning.

Figure 10:
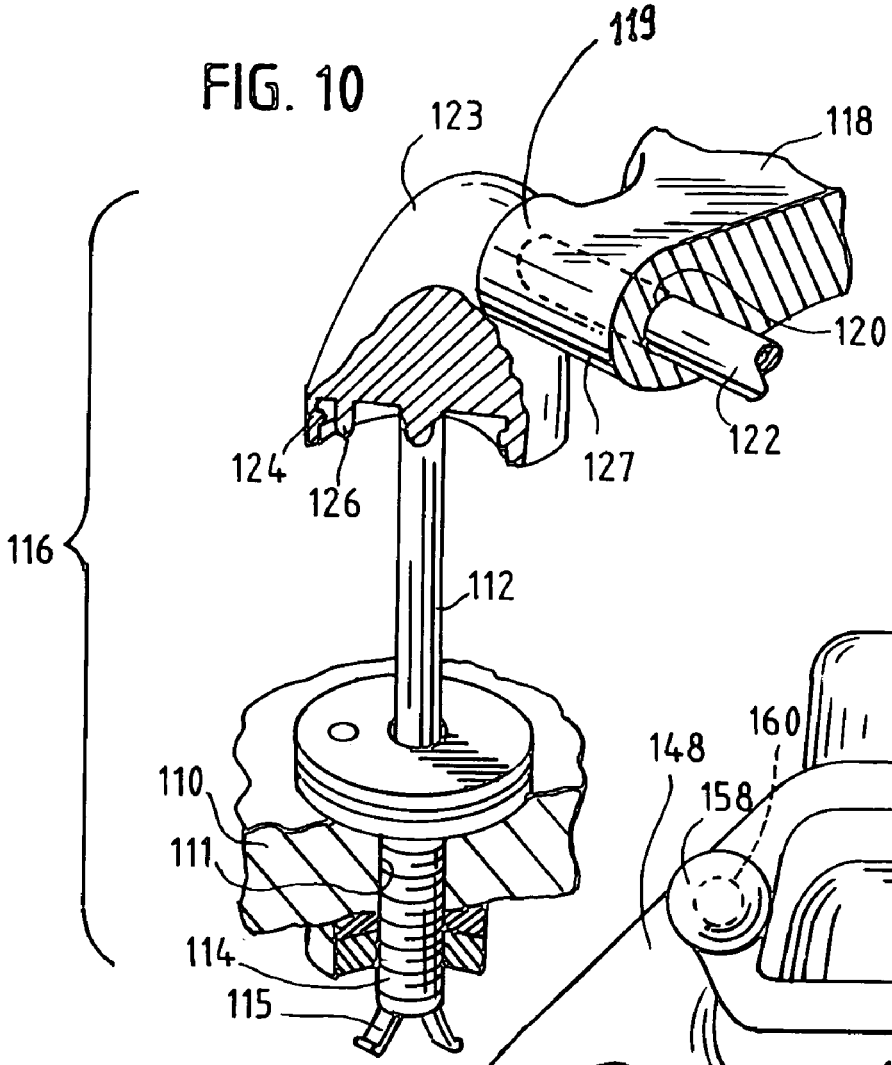
FIG. 10 is a fragmentary view, partially in section, of a fourth embodiment of the invention.
Figure 11:
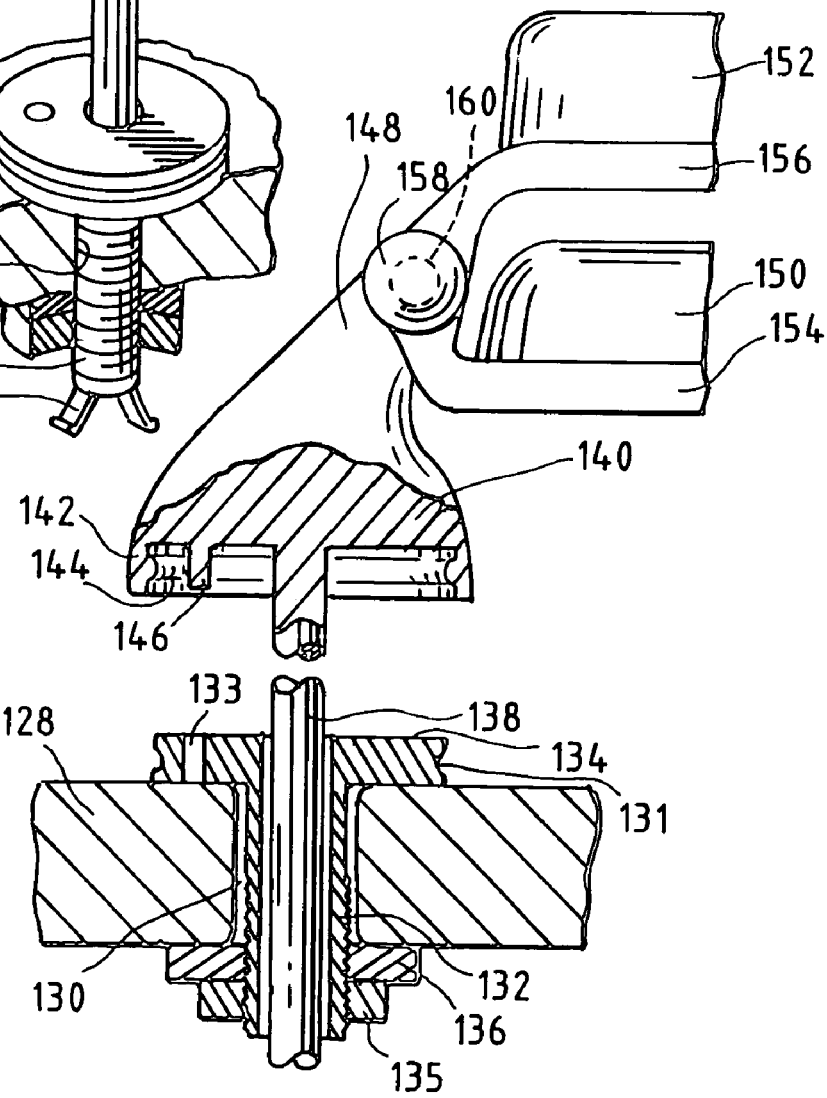
FIG. 11 is a fragmentary view, partially in section, of a fifth embodiment of the invention.

Historically, metal or synthetic flange straps 32 have been directly secured to the bowl flange using nuts and bolts. Two other seat ring mounting means are shown in FIGS. 10 and 11. In conventional toilet seat mounting the seat and cover can be positioned only in the closed position shown in broken lines in FIG. 2 or in the standard over center storage position shown in solid lines in FIG. 1. As discussed above, in past efforts to solve cleaning and maintenance difficulties, various means have been devised for separating the hinged seat and cover from the bowl flange whereby they can be stored, cleaned and sanitized in a remote location. In addition to the inconvenience, detachment and removal also exposes the bowl flange apertures and any associated attachment devices to contamination and retention of cleaning materials.

In accordance with this invention, the toilet is configured to permit conventional hinge-like mounting of a seat and seat cover for positioning in the closed position and in the upright storage position, as already described. In addition to these positions, the mounting apparatus 34 of this invention, as shown in solid lines in FIG. 2, provides an additional, elevated seat position that facilitates and simplifies cleaning and maintenance of the seat assembly and the bowl and bowl flange in a convenient, easily accessible configuration. The toilet seat mounting apparatus 34 comprises elongate posts 36 integrated with or secured to flange straps 32 and, in the use position, extends downwardly from the flange strap. The post 36 is slidable in a receptacle 38 mounted in an aperture in the bowl flange 20. Post 36 is slidable between the storage position shown in broken lines in FIG. 1 where the seat 22 and seat cover 24 rest on the bowl flange 20 and the elevated position for cleaning and maintenance as shown in solid lines in FIG. 2. The details of several embodiments are shown in subsequent figures and will be described hereinafter.

Figure 3:
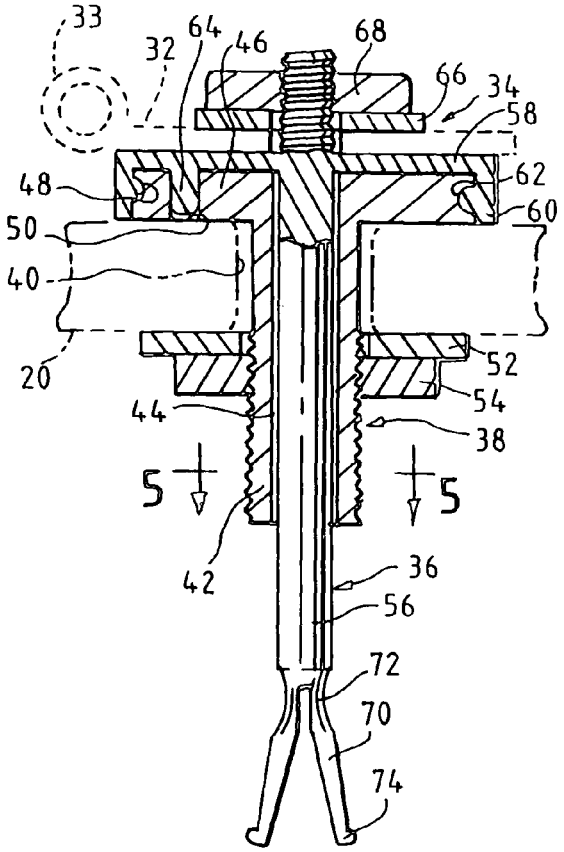
FIG. 3 is a view in section of one embodiment of the invention with a post cap resting on a receptacle head mounted in a bowl flange aperture.

Referring now to FIG. 3, the mounting apparatus 34 is shown in association with bowl flange 20 and a hinge flange strap 32, both shown in broken lines. The strap 32 has a knuckle 33 which, through a hinge pin, seat hinge strap 26 and cover hinge strap 28 rotatably supports the seat 22 and cover 24 as shown in FIGS. 1 and 2. Each receptacle 38 has a tubular body 42 with a longitudinal bore 44 and an integral head 46 and is mounted in an appropriate bowl aperture 40 in bowl flange 20. The receptacle head 46 has a peripheral recess 48 and a key hole 50. The tubular body 42 is externally threaded to receive a washer 52 and nut 54 which restrain the receptacle 38 in position on bowl flange 20. The post 36 of FIG. 3 has a cylindrical body portion 56 and an integral cap 58. The post body portion 56 may have one of many configurations as discussed with respect to FIGS. 5 and 6. The cap 58 has a rim 60 which encloses the receptacle head 46 and has a rib 62 that engages the receptacle head recess 48 for sealing and alignment. The cap 58 also has a key 64 which is received in key hole 50 for stability and alignment. The upper portion of the post 36 is threaded and fixed to the hinge strap 32 by washer 66 and nut 68.

The fit between the surfaces of the post and the receptacle should be as close as permitted by the tolerances of the manufacturing processes and physical characteristics of the materials employed. A sliding fit is desirable to provide the optimum stability when the seat is in any position on the bowl flange and during upward movement to the elevated maintenance position. It is desirable to control and limit the upward movement of the post 36 to provide spacing above the bowl flange as desired for cleaning and maintenance. In the embodiment of FIG. 3 longitudinal movement of the post 36 is controlled by a pinch prong portion 70 of post 36 which can be compressed for assembly. In use the post 36 can be raised and the pinch prongs hold the seat assembly at the desired level for cleaning and maintenance work. The pinch prongs 70 also resist over extension which might dislodge the posts from the receptacles. An area of reduced post diameter 72 is provided to facilitate assembly and better clearance where the split prongs begin. A nub 74 may be provided to alert the user to full extension and tend to avoid over extension of the post 36. The post 36 or all components of the mounting apparatus can be fabricated from a wide variety of materials. Metals such as selected aluminum and steel can be used although for ease of manufacture and cost including cost of tooling, synthetic materials are preferred. Materials such as Delrin®, an acetal resin from DuPont, and various copolymers with talc filler will be suitable for this application.

Figure 9:
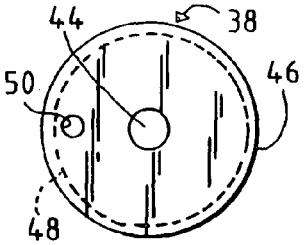
FIG. 9 is a top plan view of the receptacle of FIG. 3.
Figure 8:
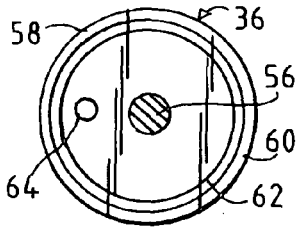
FIG. 8 is a bottom plan view of the post of FIG. 3, taken from the line 5-5.

FIG. 8 is a bottom view of the sliding post 36 looking up from line 5-5 in FIG. 3. The circular body 56 extends centrally from the integral circular post cap 58. The thicknesses of the rim 60 and of the rib 62 are indicated by two concentric circles. Key 64 is shown inwardly of the rim to provide adequate interlocking stability and clearance for manufacture and assembly. FIG. 9 is a top view of the receptacle 38 showing the bore 44, the integral head 46, the peripheral recess 48 and the keyhole 50. Post 36 and receptacle 38 are configured to cooperate in performing the functions described and to integrate the particular hinge system with the toilet bowl. Primarily for aesthetic purposes, the post cap 58 and the receptacle head 46 may have a variety of matched configurations. The configuration may be round, as shown in FIGS. 8-9. In other configurations the post cap 58 and receptacle head 46 may be curvilinear, rectangular or trapezoidal. Also for aesthetic purposes, the post cap 58 may include a corresponding shaped cover as found in some seat and cover assemblies that snap into place over the exposed portion of the assembly (not shown). Where applicable, the post cap 58 and the receptacle head 46 can be configured to cooperate and conform to the configuration of the flange straps 32.

Figure 5:
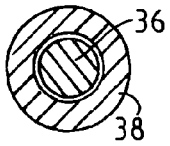
FIG. 5 is a view in section taken on line 5-5 of FIG. 3 showing one post and receptacle configuration.
Figure 6:
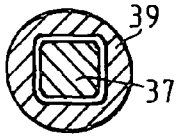
FIG. 6 is a view in section taken on line 5-5 of FIG. 3 showing an alternate embodiment of the invention.

The transverse cross sections of the post 36 and receptacle 38 are, in part, an engineering choice. FIG. 5 shows the right circular cross section of post 36 and of the outside and inside configurations of the mated receptacle 38. The clearance between the receptacle and the post is exaggerated for clarity. An alternate configuration is shown in FIG. 6. There the outside surface of the receptacle 39 is a right circular cylinder and the inside surface of the receptacle 39 and the post 37 have rectilinear cross sections. Other configurations can be used as may be dictated by structural design considerations. For example, the post 36 of FIG. 5 and post 37 of FIG. 6 may be engineered with a solid cross section, as shown, or may have a hollow configuration.

Figure 4:
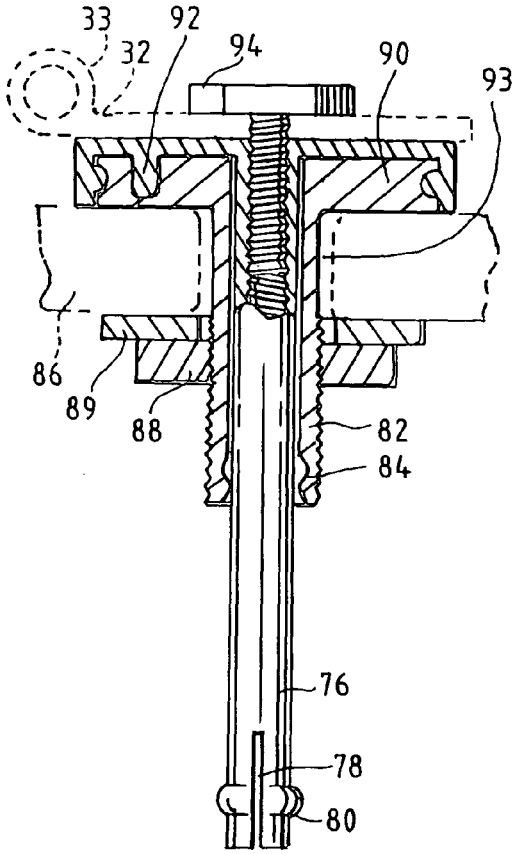
FIG. 4 is a view in section of a second embodiment of the invention.

A variation of the embodiment of FIG. 3 is shown in FIG. 4. The mounting apparatus is configured for two bowl flange apertures 93, where the pinch prongs 70, the area of reduced cross section 72 and the nub 74 are replaced. In FIG. 4 a portion of post 76 has slots 78 to provide yieldability and a ridge 80 extending outwardly from the post surface. The slots 78 permit compression of the post 76 as it enters and passes through the receptacle 82 during assembly. A recess 84 is formed in the receptacle 82 that will receive and retain the ridge 80. This will hold the post and seat assembly at the elevated level appropriate for cleaning and maintenance. Following maintenance, downward pressure on the seat assembly will release the ridge 80 from the recess 84 and permit the seat assembly to rest on the bowl flange 86. The seat assembly can be removed completely for replacement or the like by lifting the seat assembly with sufficient force to compress the slotted post 76 permitting complete withdrawal and reinsertion of the post 76 in the receptacle 82.

The receptacle 82 is threaded and is secured to the bowl flange 86 by a washer 89 and nut 88 in the manner described with respect to FIG. 3. The receptacle 82 has a head 90 corresponding to that of FIG. 3 and of FIG. 9 and functions in the same manner. The post 76 has an integral cap 92 with a rim and rim generally as shown in FIG. 8 and has a threaded bore extending into the post which receives a bolt 94 that secures the flange strap 32 with knuckle 33 against the cap 92.

Figure 7:
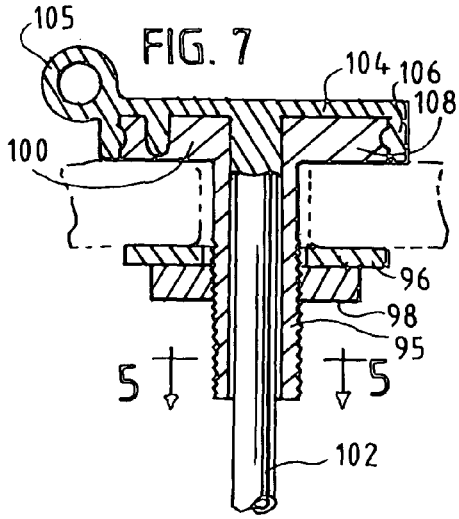
FIG. 7 is a view in section of a third embodiment of the invention.

FIG. 7 illustrates an embodiment of the invention in which each flange strap 32 with knuckle 33, the associated post 36 and post cap 58 of FIG. 3 are combined and integrated. In FIG. 7, each receptacle 95 with integral head 100, a washer 96 and a nut 98 may be configured as described in FIG. 3 or FIG. 4. The post 102 may have the distal portion as shown in FIG. 3 or FIG. 4. The post cap 104 has a rim 106 and rim 108 that cooperate with the receptacle head 100 as already described. In this embodiment the integral cap 104 also serves as the flange hinge strap by incorporating a knuckle 105 that receives the hinge pin which connects to the seat and cover either directly or on appropriate hinge straps in the manner shown in FIGS. 1 and 2.

Commercial toilet seats have the same basic mounting means as the residential toilet although they often have a different specific mounting arrangement from that described above. One such commercial toilet seat arrangement integrates, in a single mounting means, a bracket the equivalent of a hinge flange strap, a hinge pin and the mounting portion of the seat ring, with one such bracket mountable in each bowl flange aperture. Each bracket cooperates with an appropriate aperture in the mounting portion of a seat or of the seat and of the cover to permit rotation between the fully lowered, use, or closed position on the bowl flange and the over center raised storage position. The post and receptacle configuration and mounting apparatus shown and described with respect to FIGS. 1-2 are equally applicable to most configurations of commercial style mounting means for toilet seats and seat covers and seat hinge styles. The mounting apparatus of this invention will provide stable support for the seat, or the seat and seat cover, whether resting in the closed, or use, position on the bowl flange or in the upright, over center, storage position. The mounting apparatus of this invention also provides for elevation of the seat to the appropriate position above the bowl for cleaning and maintenance in the manner already described.

FIG. 10 shows a fragment of one commercial toilet seat 118 in which the seat is cut away to define a cut back mounting means seat portion acting as a seat knuckle 119. Mounting means post portion 116, partially in section, is mounted in each of two apertures 111 in a toilet bowl flange 110 and corresponds to the mounting apparatus 34 of FIGS. 3-9. In the FIG. 10 embodiment, the mounting means post portion 116 includes the equivalents of the combined bowl flange strap and cap 104 and knuckle 105 shown in FIG. 7 but with a hinge pin extending from the knuckle 105. The hinge pin in the FIG. 10 configuration may be a short integral pin and the seat knuckle may have a transverse cavity on each side to receive the short pins. In an alternative embodiment, the commercial seat may be configured with a circular mounting hole extending transversely through the seat knuckle. In that embodiment a single elongate hinge pin extends through the seat knuckle between and into recesses in two supports mounted in the bowl flange apertures. A seat cover is included in some commercial seat designs. Typically, in those embodiments the seat is cut away to define a central gap and two spaced seat knuckles. The seat cover is configured with a central cover knuckle to occupy that central gap. The cover knuckle is aligned with the seat knuckles to receive a single pin or dual pins between two mounting brackets in a manner following the general configuration of FIG. 11.

The portion of toilet seat 118 shown in FIG. 10 shows an aperture 120 to receive a hinge pin 122. The hinge pin 122 extends horizontally and transversely from the post portion which includes a dome like bracket 123 to align with a second corresponding bracket mounted in a second bowl flange aperture. In addition to the hinge pin 122 each bracket 123 comprises a cap with rim 124 and key 126 and an extendable post 112 in the manner described with respect to FIG. 7. In the configuration provided in FIG. 10 for a commercial toilet, each mounting post and receptacle supports the seat 118 on the pin 122. A receptacle 114 and the manner of attachment to bowl flange 110 may correspond in all respects to the receptacles of FIG. 3, 4 or 7. This enables the elevation of the entire seat to the maintenance position in an integrated manner although there are no conventional hinge straps involved. The particular post-receptacle interface and the interference means 115 used to support the post and the seat, or the seat and cover, in the elevated maintenance position can be as seen in FIG. 3 or in FIG. 4 or can comprise other combinations and configurations which will occur to one skilled in the art in the light of this teaching.

Most residential toilet seat hinges include knuckles as shown shown in FIGS. 1-7. However, there is a "traditional style" often replicated today, that, like the embodiment of FIG. 10, does not have a conventional hinge strap secured to the bowl flange or the seat ring. FIG. 11 illustrates, partially in section, the "traditional" mounting in a showing of the mounting means on one aperture of a bowl flange. Referring specifically to FIG. 11, a toilet bowl flange fragment 128 is shown with an aperture 130. A receptacle 132 having an integral head 134 with a recess 131 and a keyhole 133 is retained in the bowl flange aperture 130 by a washer 136 and a nut 135 in the manner shown and described with respect to FIG. 7. A post 138 is slidably mounted in receptacle 132 and has a mounting means post portion 140 having a rim 142 with a rib 144 and a key 146. The rim 142 and rib 144 cooperate with the recess 131 and key 146 cooperates with keyhole 133 in receptacle head 134 to insure stability and alignment.

Each post portion 140 has a traditional configuration including an arched arm portion 148 having a distal portion defining an aperture to receive a closely fitted hinge pin 160 for connecting the post portion 140 capped with an end closure 158. The traditional toilet has a seat 150 supported on seat portion of the mounting means 154 comprising artistic hinge straps having apertures aligned with and supported on the hinge pin 160 that connects seat portion 154 and the arm like post portions arms 148. Mounted above the seat 150 is a seat cover 152 having artistic hinge straps 156 supported on the hinge pin 160 and the arcuate arms 148 for rotation between the closed and the upright over center storage positions. The mounting apparatus is, in all functional respects like that shown in FIG. 7. The sliding relationship of the post 138 in the receptacle 132 enables elevation of the seat and seat cover above the toilet bowl to the elevated position for cleaning and maintenance. The hinge straps, hinge pin and arm portions comprise the mounting means performing in the same manner described above with respect to FIGS. 2-9.

A. A toilet comprising: a toilet bowl having a bowl flange, said flange having a plurality of apertures; a toilet seat having a seat ring and a mounting means, the mounting means comprising at least one seat portion extending from the seat ring, at least one post portion, said post portions being aligned with said flange apertures, and a connecting means joining said seat portions and said post portions, said connecting means permitting rotation of said seat ring between a generally horizontal use position, an over center storage position, and an upright maintenance position; post receptacle means secured in each of said apertures in said bowl flange; elongate post means extending downwardly from said post portions and extending through each of said receptacle means, said post means being longitudinally movable in said receptacle means; and, interference means between said receptacle means and said post means to control longitudinal motion of said post means relative to said receptacle means, whereby said seat ring can rest on said bowl flange and can be raised and supported so that said interference means reacts to releasably support said seat and provide clearance above said bowl flange for maintenance.

B. A system for supporting and selectively positioning a toilet seat ring relative to a toilet bowl flange having mounting apertures, said system comprising: a mounting means comprising at least one seat portion extending from the seat ring, at least one post portion, said post portions being aligned with said flange apertures, and an connecting means joining said seat portions and said post portions, said connecting means permitting rotation of said seat ring between a generally horizontal use position, and an over center storage position; post receptacle means secured in each of said apertures in said bowl flange; elongate post means extending downwardly from said post portions and extending through each of said receptacle means, said post means being longitudinally movable in said receptacle means to move said seat ring between said use position and an elevated over center position for maintenance; and, interference means between said receptacle means and said post means to control longitudinal motion of said post means relative to said receptacle means, whereby said seat ring can rest on said bowl flange and can be raised and supported so that said interference means reacts to releasably support said seat and provide clearance above said bowl flange for maintenance.

C. A mounting system for selectively positioning a hinged seat having hinge means to rotatably support said seat relative to an apertured toilet bowl flange comprising: post receptacle means secured in each of a plurality of apertures in said bowl flange; elongate post means extending downwardly from said hinge means and extending through each of said receptacle means, said post means being longitudinally movable in said receptacle means; and, interference means between said receptacle means and said post means to control longitudinal motion of said post means relative to said receptacle means, whereby said seat can rest on said bowl flange and can be raised so that said interference means reacts to releasably support said seat and provide clearance above said bowl flange.

D. The mounting system of paragraph C wherein the interference means is a flared end portion of each of said posts.

E. The mounting system of paragraph C wherein the interference means includes a protuberant portion of each of said posts and said receptacle means has a cooperating portion to releasable receive said protuberant portion.

F. An adjustable hinge assembly for supporting a toilet seat on and selectively positioning the seat above an apertured toilet seat bowl flange comprising: post receptacle means secured in each of a plurality of apertures in said flange; a plurality of hinges, each having a seat strap adapted for attachment to said seat and a pivotally connected flange strap; an elongate post extending downwardly from each of said flange straps, extending through and beyond each of said receptacle means and longitudinally movable in said receptacle means; and, interference means between said post and said receptacle means to control longitudinal motion therebetween whereby said seat can rest on said flange and can be raised so that said interference means reacts with said receptacle means to releasably support said seat and provide clearance above said bowl flange.

G. A toilet comprising: a toilet bowl having a bowl flange with apertures; a toilet seat configured to rest on said bowl flange; a plurality of seat hinges, each having a flange strap aligned with one of said bowl flange apertures and a seat strap secured to said seat; a post receptacle means secured in each of said bowl flange apertures; an elongate post extending downwardly from each of said flange straps and extending through the aligned receptacle, said post being longitudinally movable in said receptacle; and, interference means between said receptacle means and said post to control longitudinal motion of said post relative to said receptacle means, whereby said seat can rest on said bowl flange and can be raised whereby said interference means releasably supports said seat in an elevated position and provide clearance above said bowl flange.

H. A mounting system for selectively positioning a toilet seat on a toilet bowl flange having apertures comprising: a post receptacle means secured in each of a plurality of apertures in said bowl flange; a seat hinge associated with each of said apertures having a seat strap secured to said seat and a flange strap aligned with the associated flange aperture; an elongate post extending downwardly from each of said flange straps and extending through each of said receptacle means, said posts being longitudinally movable in said receptacle means; and, interference means between each of said receptacle means and the post extending there through to control longitudinal motion of said posts relative to said receptacle means, whereby said seat can rest on said bowl flange, can be rotated to an upright position and can be raised so that said interference means reacts with said receptacle means to releasably support said seat in an elevated position and provide clearance between said seat and said bowl flange.

I. The mounting system of paragraph H, including a seat cover, each seat hinge having a cover hinge strap secured to said cover to support said cover on said seat for rotation relative to said seat and said flange.

J. The toilet of paragraph G including a seat cover, each seat hinge having a cover hinge strap secured to said cover to support said cover on said seat for rotation relative to said seat and said flange.

K. The system of paragraph B wherein the mounting means comprises a pair of hinges and wherein said seat portion is one leaf of each hinge having a knuckle portion, said post portion is a second leaf of each hinge having a knuckle portion, and said intermediate means is a pin connecting said knuckle portions.

L. The system of paragraph B wherein the mounting means has traditional styling and comprises two arched arm post portions and two cooperating shaped seat portions, the post portions and seat portions being apertured to define knuckles, and a pin secured in said knuckles and connecting the seat portion and the post portion.

M. The system of paragraph B wherein the mounting means includes a seat portion comprising an apertured extension of the ring to define knuckles, post portions extending upwardly from said post means and connecting means comprising pin means received in said knuckles to provide a hinge-like connection.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations therof is encompassed by the invention unless otherwise indicated herein or otherwise clearly contradicted by context.

The invention claimed is:

1. A toilet comprising:

a toilet bowl comprising a bowl flange, said bowl flange comprising a plurality of apertures;

a seat ring;

a mounting apparatus comprising post portions aligned with said bowl flange apertures, and a connector joining said seat ring and post portions, said connector configured to permit rotation of said seat ring between a generally horizontal use position and an over center storage position;

post receptacles secured in each of said bowl flange apertures; and elongate posts extending downwardly from said post portions and extending through each of said post receptacles, said elongate posts being longitudinally movable in said post receptacles;

wherein said post receptacles interfere with said elongate posts to control longitudinal motion of said elongate posts relative to said post receptacles, whereby said seat ring is configured to rest on said bowl flange and is configured to be raised and releasably supported above said bowl flange for maintenance.

2. The toilet of claim 1 wherein said elongate posts each comprise a flared end portion.

3. A system for supporting a toilet seat ring relative to a toilet bowl flange comprising mounting apertures, said system comprising:

a mounting apparatus comprising post portions, and a connector configured to join said toilet seat ring and said post portions, said connector configured to permit rotation of said toilet seat ring between a generally horizontal use position, and an over center storage position;

post receptacles secured in each of said mounting apertures; and elongate posts extending downwardly from each of said post portions and extending through each of said post receptacles, said elongate posts being longitudinally movable in said post receptacles;

wherein said post receptacles interfere with said elongate posts to control longitudinal motion of said elongate posts relative to said post receptacles, whereby said toilet seat ring is configured to rest on said bowl flange and is configured to be raised and releasably supported above said bowl flange for maintenance.

4. The system of claim 3 wherein the mounting apparatus comprises:

a seat portion comprising an apertured extension of the toilet seat ring to define a first and a second knuckle, post portions extending upwardly from said elongate posts, and the connector comprising a pin received in said knuckles to provide a hinge-like connection.

5. The system of claim 3, wherein said elongate posts comprise pinch prongs.

6. The system of claim 5, wherein the pinch prongs comprise a nub.

7. The system of claim 3, wherein each of said elongate posts comprises a slot and a ridge portion and each of said post receptacles comprises a recessed portion.

8. The system of claim 3 wherein said elongate posts each comprise a flared end portion.

9. A mounting system comprising:

a hinged seat comprising a hinge and a seat;

post receptacles configured to be secured in each of a plurality of apertures in a toilet bowl flange;

elongate posts extending downwardly from said hinge and extending through each of said post receptacles, said elongate posts being longitudinally movable in said post receptacles; and wherein:

said post receptacles interfere with said elongate posts to control longitudinal motion of said elongate posts relative to said post receptacles;

said hinged seat is configured to rest on said apertured toilet bowl flange and is said hinged seat is configured to be raised and releasably supported to provide clearance above said toilet bowl flange between said hinge and said toilet bowl flange.

10. The mounting system of claim 9 wherein said elongate posts comprise pinch prongs.

11. The mounting system of claim 9 wherein each of said elongate posts comprises a slot and a ridge portion and each of said post receptacles comprises a recessed portion.

12. The mounting system of claim 9 wherein said elongate posts each comprise a flared end portion.

13. An adjustable hinge assembly for supporting a toilet seat on and positioning the toilet seat above an apertured toilet seat bowl flange comprising:

post receptacles configured to be secured in each of a plurality of apertures in said apertured toilet seat bowl flange;

a plurality of hinges, each having a seat strap adapted for attachment to said seat and a pivotally connected flange strap;

an elongate post extending downwardly from each of said flange straps, extending through and beyond each of said post receptacles and longitudinally movable in said post receptacles; and wherein said post receptacles interfere with said elongate posts to control longitudinal motion therebetween whereby said seat is configured to rest on said flange and is configured to be raised so that said post receptacle releasably supports said seat and provides clearance above said bowl flange.

14. The adjustable hinge of claim 13 wherein said elongate posts each comprise a flared end portion.

15. A toilet comprising:

a toilet bowl comprising a bowl flange with apertures;

a toilet seat configured to rest on said bowl flange; a plurality of seat hinges, each comprising a flange strap aligned with one of said bowl flange apertures and a seat strap secured to said seat;

post receptacles secured in each of said bowl flange apertures;

elongate posts extending downwardly from each of said flange straps and extending through the aligned post receptacles, said elongate posts being longitudinally movable in said receptacle; and wherein said post receptacles interfere with said elongate posts to control longitudinal motion of said elongate posts relative to said post receptacles, whereby said toilet seat is configured to rest on said bowl flange and is configured to be raised and releasably support said toilet seat in an elevated position and provide clearance above said bowl flange.

16. The toilet of claim 15 further comprising a seat cover, each seat hinge comprising a cover hinge strap secured to said cover.

17. A mounting system comprising:

a post receptacle secured in each of a plurality of apertures in a toilet bowl flange;

a seat hinge associated with each of said apertures the seat hinge comprising a seat strap secured to a toilet seat and a flange strap; and an elongate post extending downwardly from each of said flange straps and extending through each of said post receptacles, said elongate posts being longitudinally movable in said post receptacles;

wherein:

each of said post receptacles interfere with the elongate posts extending there through to control longitudinal motion of said elongate posts relative to said post receptacles, and releasably support said toilet seat in an elevated position providing clearance between said toilet seat and said toilet bowl flange.

18. The mounting system of claim 17, further comprising a seat cover, each seat hinge comprising a cover hinge strap secured to said seat cover.

19. The mounting system of claim 17 wherein said elongate posts comprise pinch prongs.

20. The mounting system of claim 19, wherein the pinch prongs comprise a nub.

21. The mounting system of claim 17, wherein each of said elongate posts comprises a slot and a ridge portion and each of said post receptacles comprises a recessed portion and further wherein the interference comprises the ridge portion releasably received in the recessed portion.

22. A toilet seat mounting system comprising:

a first toilet seat hinge comprising:

a first bracket comprising a first elongate post;

a first hinge pin between a toilet seat and the first bracket;

a second toilet seat hinge comprising:

a second bracket comprising a second elongate post;

a second hinge pin between the toilet seat and the second bracket;

a first post receptacle configured to be secured in a first aperture of a toilet bowl flange and configured to receive the first elongate post; and a second post receptacle configured to be secured in a second aperture of a toilet bowl flange and configured to receive the second elongate post;

wherein:

the first elongate post is configured to be longitudinally movable in the first post receptacle and the second elongate post is configured to be longitudinally movable in the second receptacle; and the first post receptacle is configured to interfere with the first elongate post and the second post receptacle is configured to interfere with the second elongate post to releaseably support the toilet seat in an elevated maintenance position.

23. The toilet seat mounting system of claim 22, wherein the first elongate post comprises a flared end distal to the first bracket and the second elongate post comprises a flared end distal the second bracket.

24. A toilet seat mounting system comprising:

a toilet seat hinge comprising:

a first bracket comprising a first elongate post;

a second bracket comprising a second elongate post; and a hinge pin positioned between a toilet seat and the bracket;

a first post receptacle configured to be secured in a first aperture of a toilet bowl flange, the first post receptacle configured to receive the first elongate post; and a second post receptacle configured to be secured in a second aperture of a toilet bowl flange, the second post receptacle configured to receive the second elongate post;

wherein:

the first elongate post is configured to be longitudinally movable in the first post receptacle and the second elongate post is configured to be longitudinally movable in the second receptacle; and the first post receptacle is configured to interfere with the first elongate post and the second post receptacle is configured to interfere with the second elongate post to releaseably support the toilet seat in an elevated maintenance position.

25. The toilet seat mounting system of claim 24, wherein the first elongate post comprises a flared end distal to the bracket and the second elongate post comprises a flared end distal the bracket.

26. A toilet seat mounting system comprising:

an elongate post in communication with a toilet seat; and a post receptacle configured to be secured in a toilet bowl flange and configured to receive the elongate post; and wherein:

the elongate post is configured to be longitudinally movable in the post receptacle; and the post receptacle is configured to interfere with the elongate post to releaseably support the toilet seat in an elevated maintenance position.

27. The toilet seat mounting system of claim 26, wherein the first elongate post comprises a flared end and the post receptacle interferes with the flared end.

* * * * *